US009648424B2

(12) United States Patent
Jiang et al.

(10) Patent No.: US 9,648,424 B2
(45) Date of Patent: May 9, 2017

(54) TABLET WOOFER

(71) Applicant: GOERTEK INC., Shandong (CN)

(72) Inventors: Chao Jiang, Shandong (CN); Jianbin Yang, Shandong (CN); Zhi Li, Shandong (CN); Qijin Jiao, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 14/889,103

(22) PCT Filed: May 31, 2013

(86) PCT No.: PCT/CN2013/076560
§ 371 (c)(1),
(2) Date: Nov. 9, 2015

(87) PCT Pub. No.: WO2014/180016
PCT Pub. Date: Nov. 13, 2014

(65) Prior Publication Data

US 2016/0073201 A1 Mar. 10, 2016

(30) Foreign Application Priority Data

May 8, 2013 (CN) ..... 2013 1 0166950
May 8, 2013 (CN) ..... 2013 1 0167574

(51) Int. Cl.

| | |
|---|---|
| ***H04R 9/08*** | (2006.01) |
| ***H04R 9/06*** | (2006.01) |
| ***H04R 1/22*** | (2006.01) |
| ***H04R 7/12*** | (2006.01) |
| ***H04R 9/02*** | (2006.01) |
| ***H04R 9/04*** | (2006.01) |
| *H04R 7/04* | (2006.01) |

(52) U.S. Cl.
CPC ..... *H04R 9/063* (2013.01); *H04R 1/22* (2013.01); *H04R 7/127* (2013.01); *H04R 9/025* (2013.01);
(Continued)

(58) Field of Classification Search
CPC ..... H04R 1/06; H04R 7/04; H04R 9/063
See application file for complete search history.

(56) References Cited

U.S. PATENT DOCUMENTS 4,252,211 A * 2/1981 Matsuda ..... H04R 1/22 181/166
4,899,390 A * 2/1990 Takewa ..... H04R 1/2834 181/145
(Continued)

FOREIGN PATENT DOCUMENTS

CN 101472211 A 7/2009
CN 101860783 A 10/2010
(Continued)

OTHER PUBLICATIONS

Korean Patent Office, Office Action issued in sister application KR 10-2015-7034780, Aug. 19, 2016.
(Continued)

*Primary Examiner* — Curtis Kuntz
*Assistant Examiner* — Ryan Robinson
(74) *Attorney, Agent, or Firm* — Themis Law

(57) ABSTRACT

The present invention provides a tablet woofer, including: a vibration diaphragm, at least four mutually independent driving units, and a housing for accommodating and securing the vibration diaphragm and the driving unit. The driving unit includes independent voice coil units and magnetic circuit units, the voice coil units being attached and fixed to the vibration diaphragm. The woofer further includes a FPCB communicating with an internal circuit and an external circuit, and the FPCB is disposed at two sides of the
(Continued)

housing, the part of the FPCB disposed on the side of the housing close to the voice coil units being electrically connected to the voice coil units, the part of the FPCB disposed on the side of the housing far away from the voice coil units being electrically connected to the external circuit. The woofer can solve the problems of thick and heavy voice coils and magnet performance surplus.

9 Claims, 6 Drawing Sheets

(52) U.S. Cl.
CPC ..... *H04R 9/045* (2013.01); *H04R 7/04* (2013.01); *H04R 2499/11* (2013.01)

(56) References Cited

U.S. PATENT DOCUMENTS 6,836,552 B1 * 12/2004 Bachmann ..... H04R 7/06
381/152
6,979,497 B2 * 12/2005 Katsuki ..... H01L 23/142
257/E23.006
7,548,766 B2 * 6/2009 Takahata ..... H04R 1/02
181/172
9,277,323 B2 * 3/2016 Locke ..... H04R 7/04

FOREIGN PATENT DOCUMENTS

CN 102379130 A 3/2012
CN 102640520 A 8/2012

OTHER PUBLICATIONS

State Intellectual Propery Office of the People's Republic of China, Application No. 201310166950.7, First Office Action, May 5, 2015.
State Intellectual Propery Office of the People's Republic of China, Application No. 201310167574.3, First Office Action, May 6, 2015.

* cited by examiner

TABLET WOOFER

FIELD OF THE INVENTION

The present invention relates to the acoustoelectric technical field, more specifically, to a tablet woofer.

BACKGROUND

With the social progress and technical developments, electronic products such as a TV are decreasing in size and developing towards thin thickness in recent years, and the requirements for the performance of the electronic products become more and more critical, and thus it is demanded that the volume and the thickness of the matching electronic parts decreases continuously while the performance and consistency are continuously improved. The woofer with conventional structure generally uses a tapered paper-cone vibration diaphragm. The tapered vibration diaphragm comprises a voice coil in the center thereof, and the size of the magnetic circuit system is relatively large and thick. The disadvantage of the woofer with above structure is that the thickness thereof is too large to meet the requirements of current electronic products with thinner thickness, and thus the woofer as described above is weak in practicability.

Besides, the woofer usually has a larger caliber, that is to say, has a larger vibration diaphragm area to ensure a low-frequency sound effect. If a structure having a flat-plate shaped vibration diaphragm coupled with one voice coil is used (the voice coil should be located near the edge), the vibration diaphragm with a larger area requires a voice coil with a larger size, resulting in difficult winding and easy deformation. Further, the magnet of the existing woofer is large in size, while the thicknesses of the washer and frame is are small during thinning application, thus the magnetic circuit system is easy to be saturated, and the magnet performance is surplus, resulting in wastage and relatively high cost.

Based on the above factors, it is necessary to improve the woofer with conventional structures.

SUMMARY OF THE INVENTION

In view of the above problems, the present invention has been made to provide a tablet woofer to realize the thinning of the woofers and to solve the problems of the voice coils being thick and heavy and the magnet performance being surplus.

The present invention provides a tablet woofer, comprising a vibration diaphragm, at least four mutually independent driving units and a housing for accommodating and fixing the vibration diaphragm and the driving units; wherein the driving units comprises independent voice coil units and magnetic circuit units corresponding to the voice coil units; the voice coil units are attached and fixed to the vibration diaphragm respectively; and the tablet woofer further comprises FPCB for connecting internal circuits thereof with external circuits thereof and provided at both sides of the housing, wherein a part of the FPCB provided at the side of the housing close to the voice coil units is electrically connected with the leading wires of the voice coils, and a part of the FPCB provided at the side of the housing away from the voice coil units is electrically connected with the external circuits of the woofer.

In addition, preferably, the vibration diaphragm is rectangular in shape and comprises a rigid dome part in the center thereof and a suspension ring part on the edges thereof; four voice coil units are attached to four corners of the dome part, respectively; the edges of the suspension ring part is fixedly coupled with the upper side surface of the housing.

In addition, preferably, the housing comprises a mounting plane and an annular side wall surrounding the mounting plane, and mounting holes for accommodating and fixing the magnetic circuit units and sound holes penetrating through the mounting plane are provided on the mounting plane; the sound holes comprise a central sound hole provided in the center of the mounting plane and edge sound holes provided between the annular side wall and the mounting hole; and the FPCB enables the structures of both sides of the mounting plane to be in communication with each other through the sound holes.

In addition, preferably, the FPCB is clamped and fixed on the mounting plane at the edges of the central sound hole, and one part of the FPCB is located at the side of the mounting plane close to the vibration diaphragm, and the other part is located at the side of the mounting plane away from the vibration diaphragm.

In addition, preferably, the FPCB comprises two mutually independent parts, and each part is electrically connected with two voice coil units thereto.

In addition, preferably, the FPCB is partially attached and fixed to the side of the vibration diaphragm attached with the voice coil unit, and the part of the FPCB which is not attached and fixed to the vibration diaphragm extends to the side of the mounting plane away from the vibration diaphragm through the sound holes.

In addition, preferably, the FPCB has a strip shape, and the middle part of the FPCB is attached and fixed to the vibration diaphragm, and both ends of the FPCB extend to the side of the mounting plane away from the vibration diaphragm through the edge sound holes.

In addition, preferably, both front and back surfaces of the FPCB are provided with pads, and there is a one-to-one correspondence relationship between the pads provided on the front surface of the FPCB and the pads provided on the back surface of the FPCB; wherein, the pads provided on the front surface of the FPCB are electrically connected with each of the voice coil cells, respectively, and the series or parallel connection between the voice coil units are controlled by the pads provided on the back surface of the FPCB.

It can be seen from the above technical solution that the tablet woofer of the present invention can achieve the following advantageous effects:

1) four driving units are provided at four corners of the dome part of the vibration diaphragm respectively, and the rest of the driving units are relatively uniformly provided at one or two groups of opposite sides formed by the driving units at corners, and with such a structure, it is possible to use small-size voice coil units and magnetic circuit units to drive the large-size vibration diaphragm of the woofer, which can reduce the thickness of the woofer, save the size of the magnets to reduce cost and improve the sensitivity of the woofer; besides, the structure that the driving units are provided at the corners is beneficial to the balanced driving of the vibration diaphragm of the woofer;

2) the housing uses aluminum alloy materials with high strength and high stability;

3) the voice coil and the external circuits are connected with each other using the FPCB (Flexible Printed Circuit Board, called FPCB or FPC for short), thereby saving space, and the leading wires of the voice coils located on the mounting surface or connecting with the vibration diaphragm, are directly welded with the bonding pads of the FPCB, so that the length of the leading wires can be shortened to the greatest extent, and the stability of product can be improved, and the internal space of the woofer can be in full use to make product thinner.

In order to achieve the above and other related objectives, one or more aspects of the present invention include the features to be described in detail in the followings and particularly pointed out in the claims. The following descriptions and accompanying drawings describe certain illustrative aspects of the present invention in detail. However, these aspects only indicate some ways of the various ways which can use the principle of the present invention. In addition, the present invention intends to include all these aspects and their equivalents.

BRIEF DESCRIPTION OF THE DRAWINGS

Other purposes and results of the present invention will be more clearly and easily understand with reference to the illustration in combination with accompanying drawings and the claims and as with a more comprehensive understanding of the present invention. In the drawings:

FIG. 3-1 and FIG. 3-2 are schematic diagrams showing the connection of four voice coils according to embodiment I of the present invention, respectively;

FIG. 9-1 and FIG. 9-2 are schematic views showing the connection of six voice coils according to embodiment II of the present invention, respectively;

Figure 1:
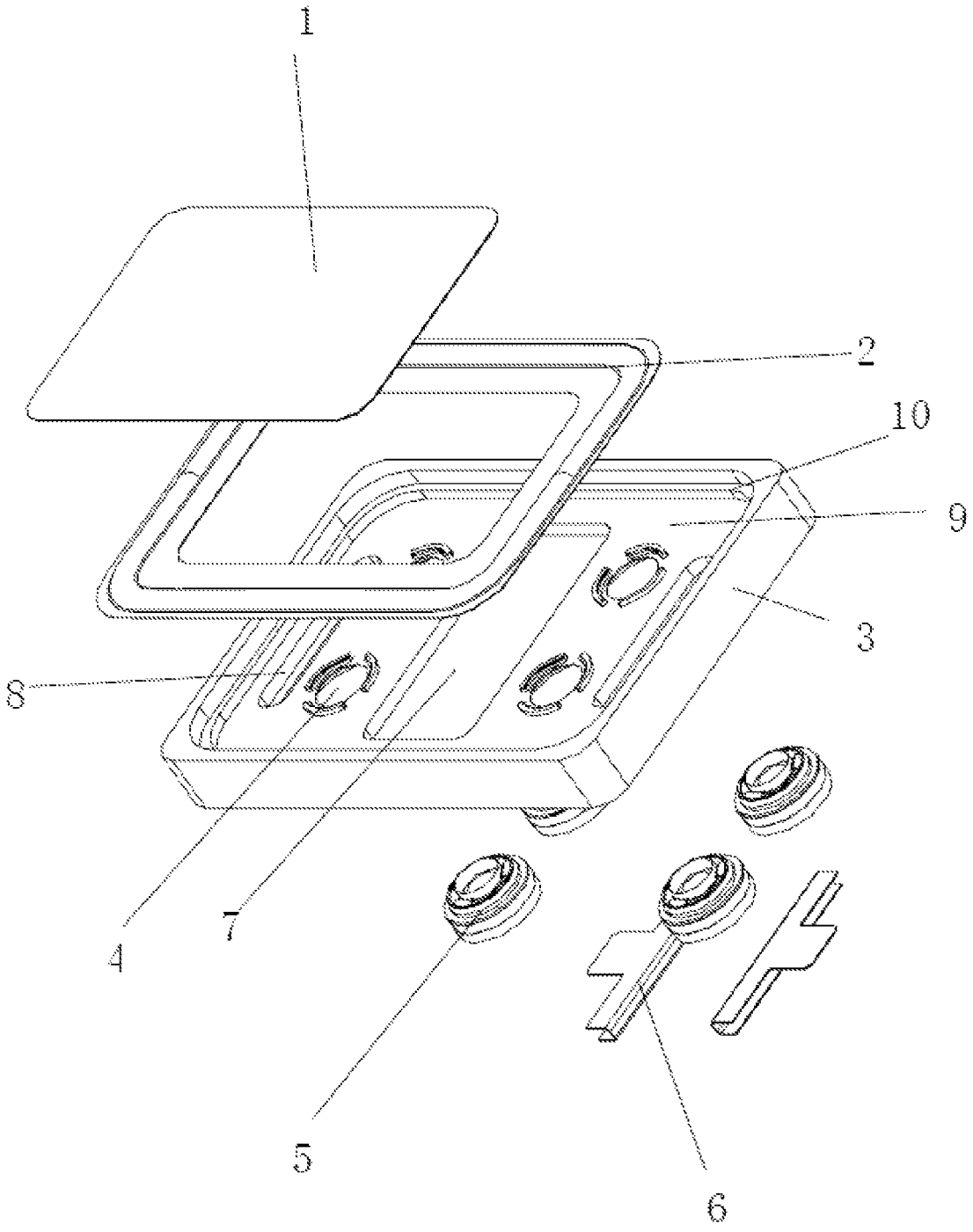
FIG. 1 is a structural schematic diagram of the tablet woofer according to embodiment I of the present invention.

The reference numbers of the accompanying drawings comprise: dome part 1, suspension ring part 2, housing 3, mounting holes 4, driving units 5, FPCB 6, central sound hole 7, edge sound holes 8, mounting plane 9, annular side wall 10, pad 11, front surface of FPCB A, back surface of FPCB B, fixing hole 12, electrical circuit 13, leading wires of voice coil 14.

The same reference numbers in all figures indicate similar or corresponding features or functions.

DETAILED DESCRIPTION OF THE EMBODIMENTS

Various specific details are set forth in the following description to provide a comprehensive understanding of one or more embodiments for sake of illustration. However, it is obvious that these embodiments can be implemented without such specific details. Specific embodiments will be described more fully hereinafter with reference to the accompanying drawings The woofer needs a large area of the vibration diaphragm. In order to provide the large-area vibration diaphragm with enough driving power on the basis of limiting the size of voice coils and magnets, the present invention embarks from the view angle of the distributed arrangement of multiple independent driving units so that the vibration diaphragm can be driven by multiple independent voice coils, and each voice coil corresponds to an independent magnetic circuit unit, thus realizing the miniaturization of the woofer by using a more reasonable and effective arrangement structure of the driving units.

FIG. 1 is a structural schematic diagram of the tablet woofer according to embodiment I of the present invention.

As shown in FIG. 1, the tablet woofer provided by the present invention comprises a vibration diaphragm, four mutually independent driving units 5 and a housing 3.

Wherein, the vibration diaphragm has a flat-plate shaped rectangular structure, the shape of which can be rectangular or square, and which comprises a rigid dome part 1 of the vibration diaphragm in the center thereof and a suspension ring part 2 of the vibration diaphragm on the edges thereof, and the edges of the suspension ring part 2 is fixedly coupled with the upper side surface of the housing. In the present invention, in order to enlarge the effective vibration area of the vibration diaphragm, the ratio of the equivalent radius of the effective radiating area of the dome part 1 to the width of the suspension ring part is defined in the numerical range of 4 to 15, that is, 4<equivalent radius of the effective radiating area: width of the suspension ring part<15.

The dome part 1 of the vibration diaphragm is made of aluminum alloy material to ensure the hardness and rigid structure thereof, and the rigid structure can improve the acoustic characteristic of the vibration diaphragm. In the embodiment of the present invention, the dome part 1 of the vibration diaphragm may have a honeycomb structure or a foam body structure, both of which can also improve the acoustic characteristic of the vibration diaphragm. The suspension ring part 2 of the vibration diaphragm may be made of PU (Polyurethane) or silicon rubber.

The driving unit 5 comprises a voice coil unit and a magnetic circuit unit, and each voice coil unit corresponds to each magnetic circuit unit. The tablet woofer of embodiment I comprises four driving units, and the four driving units 5 can be provided at four corners of the dome part 1 of the vibration diaphragm respectively; if the tablet woofer comprises more than four driving units, the voice coils of the driving units can be uniformly provided on the peripheral area of the dome part 1 of the vibration diaphragm, or provided on the dome part in an dispersive and irregular arrangement to avoid resonance.

The driving unit has a round shape and comprises a round voice coil unit and a round magnetic circuit unit, wherein, the voice coil unit comprises a voice coil, a voice coil framework and a damper, and the magnetic circuit unit comprises a washer, a magnet and a T-iron. The voice coil and the vibration diaphragm are fixedly coupled. The voice coil framework is used to support the voice coils, so that the voice coils are located at a proper position in the magnetic gap. The damper is used for fixing the voice coils to prevent the voice coils from polarizing in the horizontal direction.

In the present exemplary embodiment, the driving units have a round structure, which can ensure that the vibration diaphragm suffers a more even force when compared with a rectangular voice coils. Both the washer and the T-iron are of guide magnetic structures to modify magnetic lines; and the magnetic gap formed between the magnet and the T-iron is used for accommodating the voice coils.

In embodiment I as shown in FIG. 1, there are four driving units 5, in which four voice coils are provided at four corners of the vibration diaphragm corresponding to the dome part 1 respectively, which is beneficial to the stable coupling between the voice coils of the driving units 5 and the vibration diaphragm, and makes the vibration diaphragm be driven in equilibrium.

In this structure, small-size voice coil units and magnetic circuit units are used to drive the large-size vibration diaphragm of the woofer, which can reduce the thickness of the woofer save the magnet size so as to reduce the costs and improve the sensitivity of the woofer. Four driving units 5 acting on the vibration diaphragm with uniform driving force can ensure the driving power high enough on the basis of reducing the size of the driving units, and thus the products are can realize further thinning. Such performance can enable the tablet woofer of the present application to be applied to electronic devices with high power, such as liquid crystal display television.

The housing 3 comprises a mounting plane 9 and an annular side wall 10 around the mounting plane. Fixing holes (not shown in FIG. 1) can be arranged on the edges of the annular side wall 10, so that the flat-plate woofer and the electronic devices can be fixedly coupled with each other. The fixing holes can be arranged at one side of the annular side wall away from the vibration diaphragm, and one circle of extension part can also be added to the periphery of the annular side wall. Generally, the fixing holes are uniformly arranged on the edges to make the fixing force balanced.

The housing uses aluminum alloy materials with high strength and good stability.

Mounting holes 4, the number and the position of which correspond to that of the driving units, and sound holes penetrating through the mounting plane are provided on the mounting plane 9. Limiting parts for defining the position of damper are provided in the mounting holes 4 of the mounting plane 9. The mounting holes 4 are used for accommodating the voice coil units and mounting and fixing the magnetic circuit units. The sound holes comprise a central sound hole 7 and edge sound holes 8. The central sound hole 7 is provided in the center of the mounting plane 9, corresponding to the middle region of the vibration diaphragm. The edge sound holes 8 are provided between the annular side wall 10 and the mounting holes 4. With respect to the whole mounting plane, the edge sound holes 8 are provided on the edge corresponding to the central sound hole 7.

The size of the central sound hole 7 is larger than that of the edge sound hole 8, and the ratio of total area of the sound holes to the effective radiation area of the flat-plate woofer is 0.07 to 0.6; since the amount of the airflow generated by the dome part 1 of the vibration diaphragm is larger, big sound holes are beneficial to the circulation of the airflow.

For a rectangular vibration diaphragm, the middle region of the vibration diaphragm is relatively larger and the airflow generated by the intermediate region of vibration diaphragm is relatively more, therefore, central sound hole 7 is provided at the position of the mounting plane 9 corresponding to the middle region. Besides, the size of the central sound hole 7 is relatively larger, so that more airflow flows in or out from here.

In the embodiment I shown in FIG. 1, the edge sound hole 7 has a strip shape, and the edge sound hole 7 and the central voice outlet 8 are provided on the mounting plane in parallel. It can be sure that the edge sound holes can be designed to be in a round shape or in other irregular shapes according to the application requirements of the woofer.

The upper side surface of the annular side wall 10 of the housing is fixedly coupled with the edge of the folding ring part 2 of the vibration diaphragm.

The tablet woofer further comprises FPCB 6 for connecting the internal circuits with external circuits of the woofer, and the FPCB according to the present invention are provided at both sides of the housing, wherein one part of the FPCB is provided at the side where the housing is close to the voice coil units and is electrically connected with the voice coils via the leading wire of the voice coils; the other part of the FPCB is provided at the side where the housing is away from the voice coil units and is electrically connected with the external circuits of the woofer.

Figure 2:
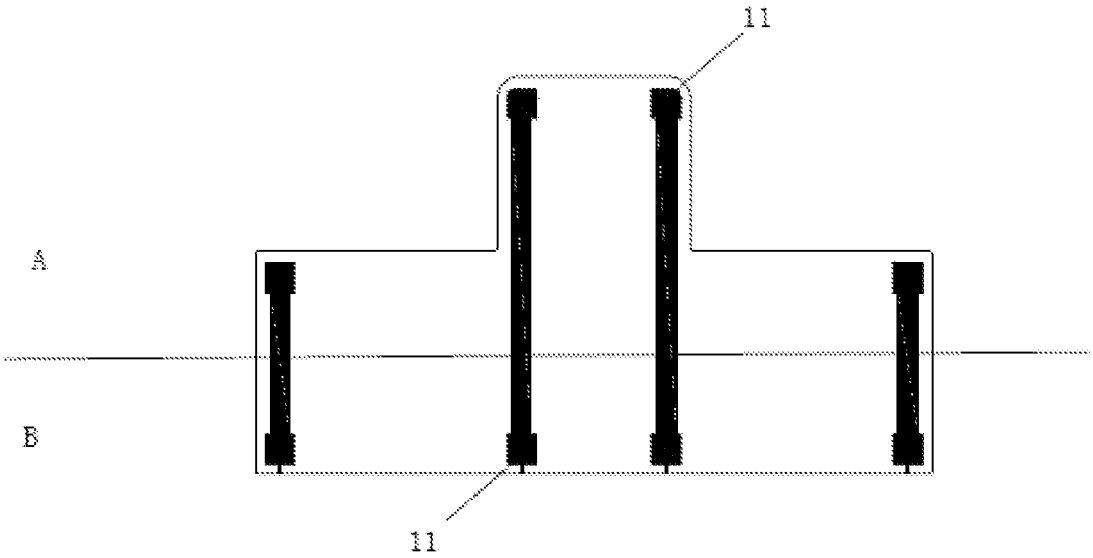
FIG. 2 is a structural schematic diagram of the FPCB according to embodiment I of the present disclosure.

FIG. 2 is a structural schematic diagram of the FPCB according to the embodiment I of the present invention. As shown in FIG. 2, the FPCB of embodiment I has a T-shaped structure and comprises two mutually independent parts, each part of which is electrically connected with two of the voice coil units adjacent thereto. Both front surface A and back surface B of the FPCB 6 are provided with pads 11, and there is a one-to-one correspondence relationship between the the pads 11 provided on the front surface of the FPCB and the pads provided on the back surface of the FPCB; the pads provided on the front surface of the FPCB are electrically connected with each of the voice coil units respectively, and the serial or -parallel connection between the voice coil units are controlled by the connection between the pads 11 provided on the back surface of the FPCB and the external circuits. That is to say, the pads 11 of the front surface at the side where the FPCB is close to the voice coils are electrically connected with the leading wires of the voice coils, and the pads 11 of the back surface at the side away from the voice coil units are electrically connected with the external circuits of the woofer.

It is noted that the specific shape of the FPCB can be adjusted according to the requirement of the electronic device, and the circuit configuration of the pads is not limited to the case as shown in FIG. 2, and other arrangements can be utilized according to the requirements of the specific products.

During the electric connection of the voice coils, the voice coils can be flexibly connected in series, in parallel or in series-parallel. Hereinafter, two electrical connection manners of the voice coil units are illustrated exemplarily.

Figures 1, 3:
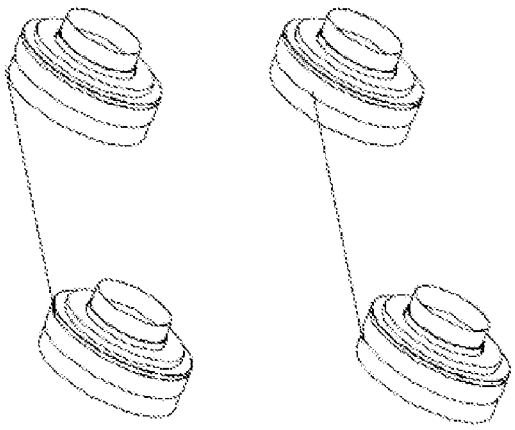
Figures 2, 3:
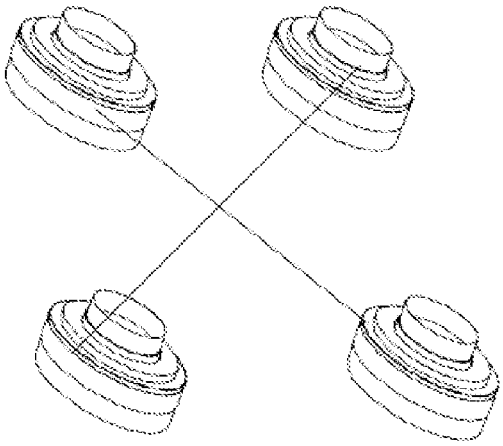

FIG. 3-1 and FIG. 3-2 are schematic diagrams showing the connection of four voice coils according to the embodiment of the present invention, respectively. As shown in FIG. 3-1, two voice coil units belonging to the same straight line and the same side are connected in series respectively, and two branches can be formed, and then the two branches are connected in parallel via the FPCB. As shown in FIG. 3-2, two voice coil units located at the corners on the same diagonal line are connected in series, and two branches can be formed, and then the two branches are connected in parallel via the FPCB.

Electronic devices (such as liquid crystal display television) are electrically connected with the side of the FPCB which is away from the mounting plane, and the FPCB is clamped and fixed on the mounting plane of the edge of the central sound hole.

In one embodiment of the present invention, the FPCB uses a polyimide CCL base material and has a rigid structure, and compared with the existing plastic structure, the polyimide CCL base material has a stronger elastic and is less likely to be ruptured.

Figure 4:
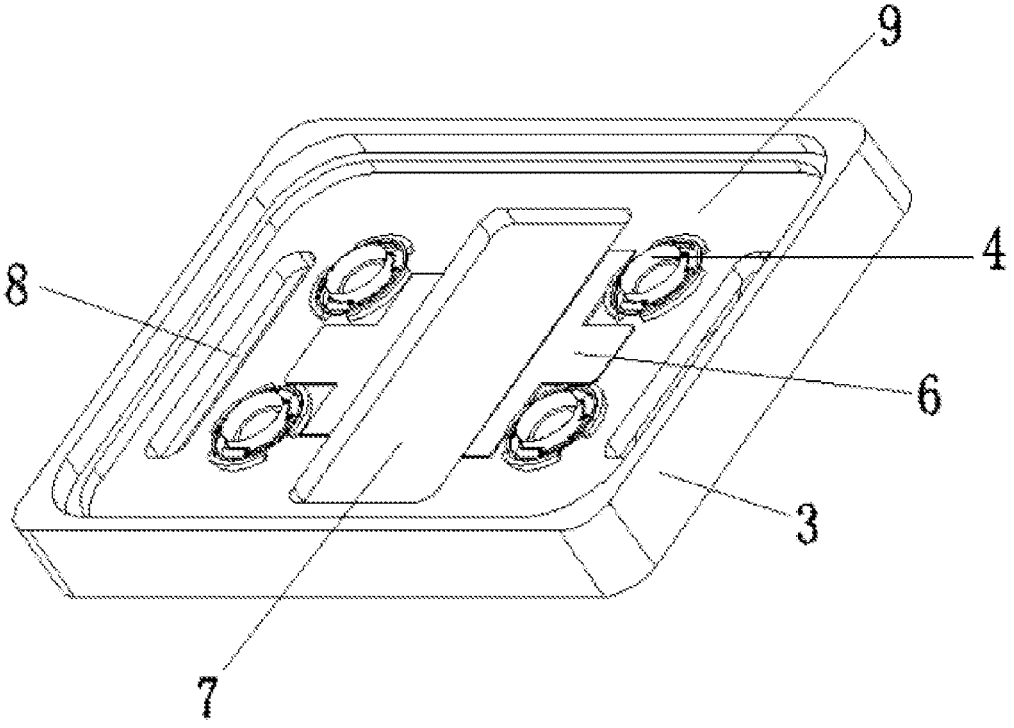
FIG. 4 is a schematic diagram showing the front surfaces of the FPCB and the housing according to embodiment I of the present invention.
Figure 5:
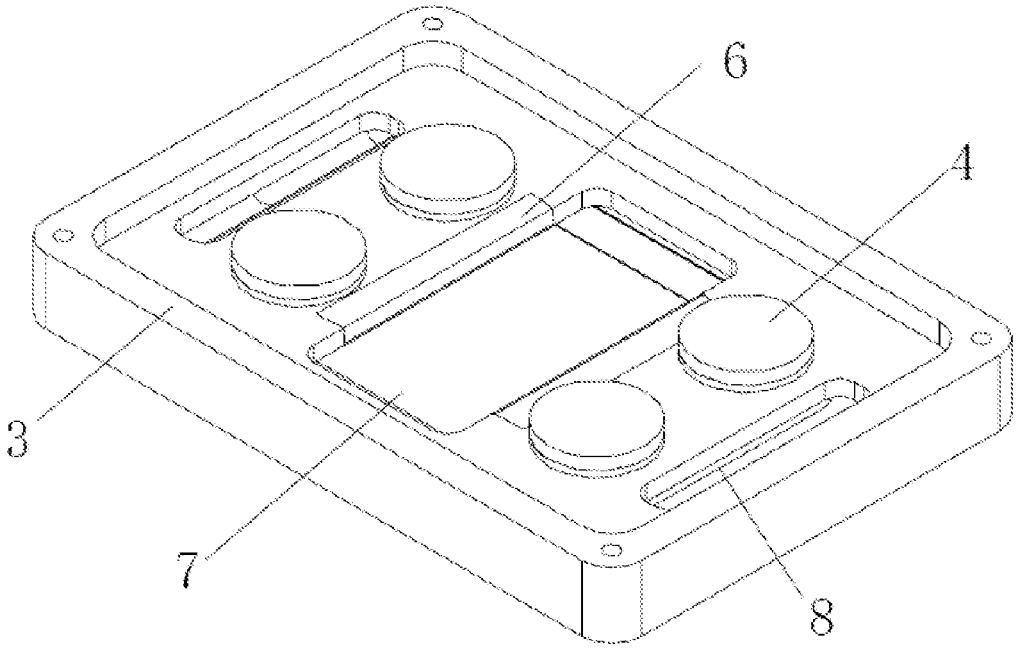
FIG. 5 is a schematic diagram showing the back surfaces of the FPCB and the housing according to embodiment I of the present invention.

FIG. 4 and FIG. 5 are schematic diagrams showing the front and back surfaces of the FPCB and the housing according to embodiment I of the present invention.

As shown in FIG. 4 and FIG. 5, the FPCB 6 of the embodiment is provided at both sides of the housing 3, wherein the side of the FPCB close to the voice coil units are electrically connected with the leading wires of the voice coils, and the side of the FPCB away from the voice coil units are electrically connected with the external circuits of the woofer. The FPCB 6 enables the structures of both sides of the mounting plane 9 to be in communication with each other through the sound holes, and the FPCB 6 and the housing 3 are fixedly coupled with each other by bonding or engagement.

In embodiment I, the FPCB 6 has a T shape, and is clamped and fixed on the mounting plane 9 of the edge of the central sound hole 7. Multiple welding pads (not shown in FIGS. 4 and 5) are arranged on the FPCB 6. The welding pads are connected with the voice coil units and the external circuits.

Since the FPCB 6 is clamped and fixed on the mounting plane, one part of the FPCB 6 is located at the side of the mounting plane 9 which is close to the vibration diaphragm, and the other part is located at the side of the mounting plane 9 which is away from the vibration diaphragm.

Since many driving units are used in the present invention, the driving units and the external circuits are electrically connected by the FPCB in the embodiment I of the present invention. Compared with ordinary connecting manner using wire, the connecting manner using the FPCB of can simplify the manufacturing process, and since the FPCB is only coupled to the mounting plane, the gap between the magnetic circuit units on the mounting plane and the internal space of the woofer are fully utilized, so that the internal space of the woofer can be saved and the stability of the woofer can be improved. Furthermore, the number of the driving units is not limited to four, and six or more driving units can be used, which can be electrically connected by such a FPCB.

Taking the tablet woofer with six driving units for example, the application of electrically connecting the driving units with the external circuits of the woofer by using the FPCB will be described below.

Figure 6:
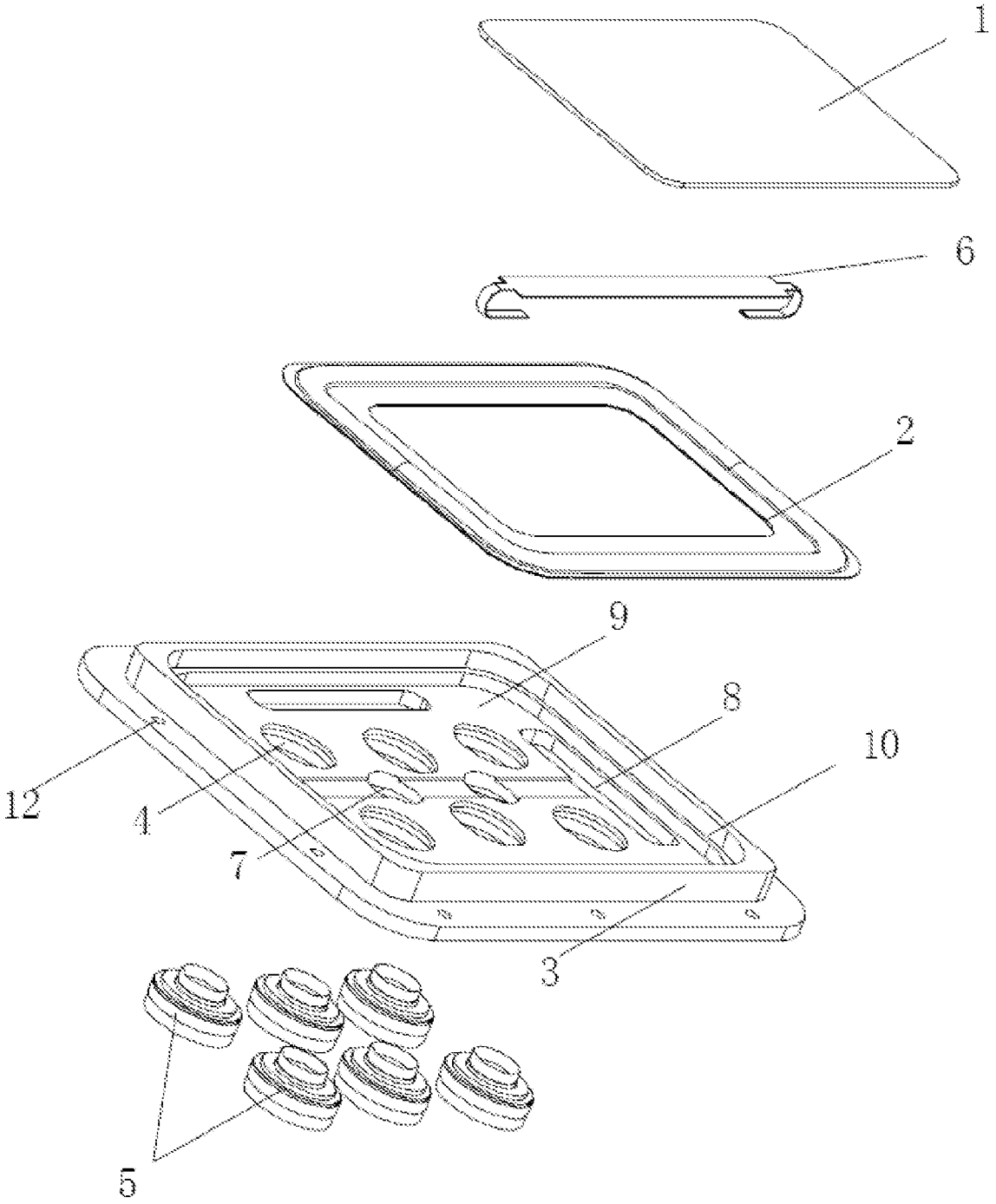
FIG. 6 is a structural schematic diagram showing the woofer having six driving units according to embodiment II of the present invention.

FIG. 6 is a structural schematic diagram showing the tablet woofer having six driving units according to embodiment II of the present invention.

As shown in FIG. 6, the tablet woofer provided by embodiment II comprises a vibration diaphragm, six mutually independent driving units 5 and a housing 3. Similarly, four voice coil units are attached and fixed to four corners of the dome part 1 of the vibration diaphragm respectively and the edge of the suspension ring part 2 is fixedly coupled with the upper side surface of the housing 3. The housing 3 comprises a mounting plane 9 and an annular side wall 10 around the mounting plane. Six mounting holes 4 used for accommodating voice coil units and mounting and fixing the magnetic circuit units and corresponding to the number and the position of the six driving units and six sound holes penetrating through the mounting plane are provided on the mounting plane 9, wherein the six sound holes comprise two round central sound holes 7 and four strip-shaped edge sound holes 8. It can be sure that the edge sound holes can be designed to be in a round shape or in other irregular shapes according to the application requirements of the woofer.

It can be seen that except for four voice coils provided at the corners of the dome part of the vibration diaphragm, there are two voice coil units which are provided at one set of opposite sides of the dome part. Similarly, if there are more than six driving units, the corresponding voice coil units can be uniformly provided at one or two sets of opposite sides of the rectangular dome part respectively.

In embodiment II as shown in FIG. 6, each of the two voice coil units respectively provided on one set of opposite sides and the other two voice coil units provided at two corners of the side where each of the two coil units is located are in a straight line and uniformly arranged to balance the driving force of the vibrating diaphragm generated by the driving units, thereby evenly driving the vibrating diaphragm to move up and down. Each of the two voice coil units respectively provided on one set of opposite sides and the other two voice coil units provided at two corners of the side where each of the two coil units is located can be set not to be in a straight line and be non-uniformly arranged to avoid the resonance of the vibrating diaphragm. In the embodiment II as shown in FIG. 6, the fixing holes 12 for fixedly coupling the tablet woofer with the electronic device are provided on the extending parts surrounding the annular side wall.

Furthermore, unlike embodiment I, the FPCB 6 adopted in embodiment II is strip-shaped, the middle part of the FPCB is attached and fixed to the side of the vibration diaphragm attached with voice coil units, and both ends parts of the FPCB, i.e., the parts not attached and fixed to the vibration diaphragm, extend to the side of the mounting plane 9 away from the vibration diaphragm via the edge sound holes.

Figure 7:
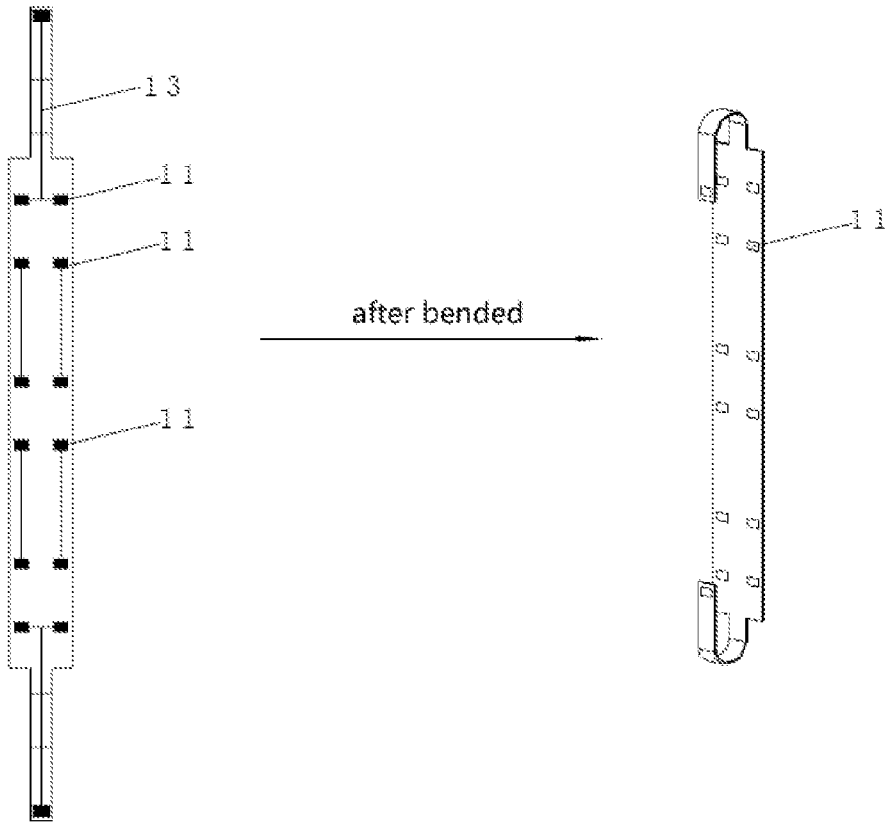
FIG. 7 is a structural schematic diagram showing the FPCB according to embodiment II of the present invention.

FIG. 7 is a structural schematic diagram showing the FPCB according to embodiment II of the present invention.

As shown in FIG. 7, a circuit 13 connected with an external circuits is provided at the end of the FPCB; the middle part of the FPCB is provided with a plurality of pads 11, and the voice coil units are electrically connected with the pads 11 provided on the part of the FPCB fixed on t the vibrating diaphragm. The middle part of the FPCB is fixed to the side of the vibration diaphragm coupled with the voice coil units, and the part of the FPCB (i.e., both ends parts) which is not fixed to the vibration diaphragm can extend to the side of the mounting plane away from the vibration diaphragm through the edge sound holes of the housing. Both ends pats of the FPCB are bent in an arc shape to the position in parallel with the mounting plane. Such a structure can make full use of the internal space of the woofer, and the disconnection due to the traction of the lead wires during the vibration of the vibrating diaphragm can be avoided.

Figure 8:
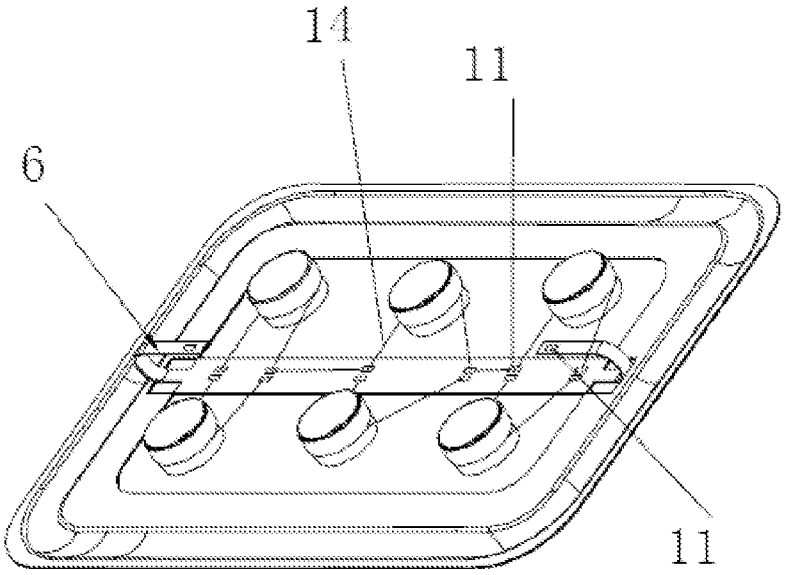
FIG. 8 is a schematic diagram showing the FPCB installing on the tablet woofer according to embodiment II of the present invention.

FIG. 8 is a schematic diagram showing the FPCB installing on the tablet woofer according to embodiment II of the present invention.

As shown in FIG. 8, the middle part of the FPCB 6 is mounted at the side of the vibrating diaphragm coupled with the voice coil unit, and the voice coil units are electrically connected with the pads 11 provided on the part of the FPCB 6 fixed to the vibrating diaphragm. Both ends parts of the FPCB 6 extend to the side of the mounting plane away from the vibration diaphragm through the sound holes. Both ends parts of the FPCB 6 are bent in an arc shape to the position in parallel with the mounting plane.

Both the front surface and back surface of the FPCB 6 are provided with pads 11, and there is a one-to-one correspondence relationship between the pads 11 provided on the front surface of the FPCB and the pads 11 provided on the back surface of the FPCB; wherein, the pads provided on the front surface of the FPCB 6 are electrically connected with each of the voice coil units respectively, and the series or parallel connection between the voice coil units are controlled by the pads provided on the back surface of the FPCB.

The electrical connection of the six voice coil units of embodiment II are described exemplarily below.

Figures 1, 9:
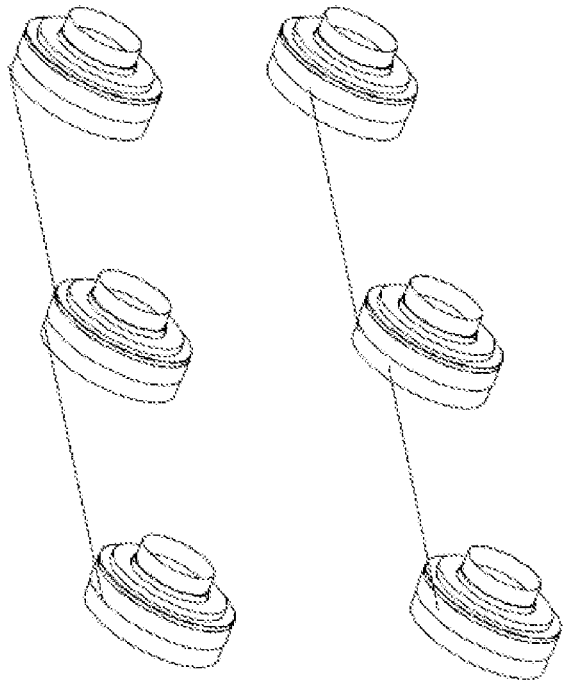
Figures 2, 9:
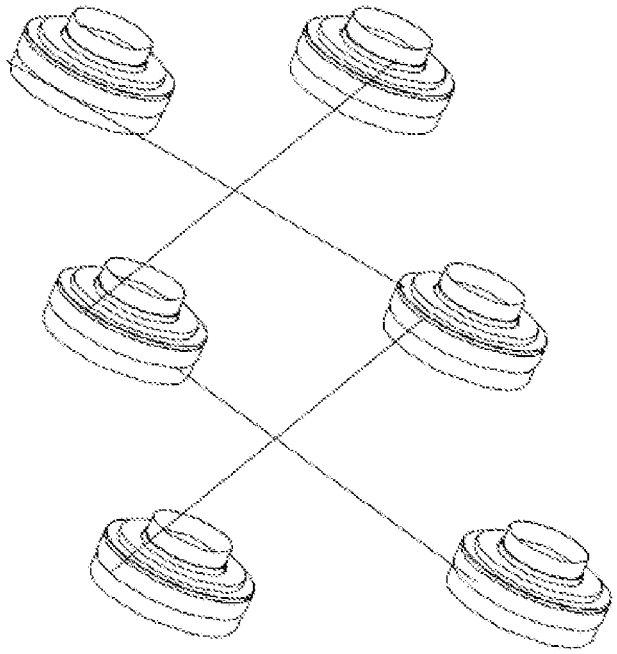

FIG. 9-1 and FIG. 9-2 are schematic diagrams showing the connection of six voice coils of embodiment according to the present invention, respectively. As showed in FIG. 9-1, six voice coils are connected in such a manner: three voice coil units locating on the same straight line are connected in series, respectively, so that two branches can be formed, and then the two branches are connected in parallel. As shown in FIG. 9-2, six voice coils are connected in such a manner: two voice coils located at the corners of the side, i.e., the same straight line and the same side are connected with the voice coil on the opposite side in series, respectively, so that two branches are formed, and then the two branches are connected in parallel.

According to the connection type of the voice coil units as shown in FIG. 9-2, if there is a problem existing in one or more driving units of one branch, the tablet woofer can also work properly, and this is because the other branch is uniformly distributed in the area of the dome part of the vibrating diaphragm to make the vibrating diaphragm bear averaged force. Meanwhile, since both ends of the FPCB is relatively thin and bent with certain radian, the resistance exerted on the vibrating diaphragm by the FPCB during the vibration of the vibrating diaphragm can be minimized so as to make the vibrating diaphragm bear averaged force.

It can be seen from the above implementations that the tablet woofer provided by the present invention has at least four driver units provided at four corners of the dome part of the vibrating diaphragm, and two or more driving units can be provided at the long axis thereof, and such a structure not only facilitates the stable coupling between the voice coils of the driving units and the vibrating diaphragm, and the small-size voice coils units and the magnetic circuit units are used to drive the large-size vibrating diaphragm of the woofer in order to reduce the thickness of the woofer, save the size of the magnet so as to lower the cost and improve the sensitivity of the woofer.

Additionally, in one preferred implementation of the present invention, the driving units at the same side of the long axis sides are not arranged in a straight line and with the spacing ratio which is not an integral ration, and the distance between the two driving units located in the middle of the two opposite sides respectively is less than the distance between the two driving units located at the corners, and when the vibrating diaphragm was driven by the driving units with above arrangement structure, the drawbacks caused by resonance of the vibrating diaphragm can be avoided, and meanwhile, the uniform driving force can drive the vibrating diaphragm uniformly, enabling the woofer to be used to electronic devices with larger power. Additionally, in the present invention, the voice coils and the external circuits are connected by FPCB, which can save space; and the lead wires of the voice coils connected with the vibrating diaphragm are directly welded with the pads of the FPCB, so that the disconnection of the leading wires of the voice coils due to vibration of the vibrating diaphragm can be avoided.

As described above, the tablet woofer provided by the present invention is described by way of example with reference to the accompanying drawings. However, it should be understood by those skilled in the art that various improvements can be made to the plate-type woofer provided by the present invention as described above without departing from the contents of the present invention. Accordingly, the scope of protection of the present invention is determined by the contents of the appended claims.

The invention claimed is:

1. A tablet woofer, comprising:

a vibration diaphragm, at least four mutually independent driving units, and a housing for accommodating and fixing the vibration diaphragm and the driving units;

wherein, the driving units comprise independent voice coil units and magnetic circuit units corresponding to the voice coil units, and the voice coil units are attached and fixed to the vibration diaphragm respectively;

the tablet woofer further comprises a FPCB (Flexible Printed Circuit Board) for connecting internal circuits with external circuits of the woofer, wherein the FPCB is provided at both sides of the housing, wherein a part of the FPCB provided at a side of the housing close to the voice coil units is electrically connected with the voice coil units via leading wires of the voice coils, and a part of the FPCB provided at a side of the housing away from the voice coil units is electrically connected with the external circuits of the tablet woofer;

the housing comprises a mounting plane and an annular side wall surrounding the mounting plane, and mounting holes for accommodating and fixing the magnetic circuit units and sound holes penetrating through the mounting plane are provided on the mounting plane;

the sound holes comprise a central sound hole provided in the center of the mounting plane and edge sound holes provided between the annular side wall and the mounting holes; and, the FPCB enables both sides of the mounting plane to be in communication with each other through the sound holes.

2. The tablet woofer according to claim 1, wherein, the vibration diaphragm is rectangular in shape, and comprises a rigid dome part in the center thereof and a suspension ring part on the edge thereof;

four voice coil units are attached to four corners of the dome part, respectively; and, edges of the suspension ring part are fixedly coupled with an upper side surface of the housing.

3. The tablet woofer according to claim 1, wherein, the FPCB is clamped and fixed on the mounting plane at the edge of the central sound hole, and one part of the FPCB is located at a side of the mounting plane closer to the vibration diaphragm, and the other part of the FPCB is located at a side of the mounting plane away from the vibration diaphragm.

4. The tablet woofer according to claim 3, wherein, the FPCB comprises two mutually independent parts, each part of which is electrically connected with two of the voice coils adjacent thereto.

5. The tablet woofer according to claim 1, wherein, the FPCB is partially attached and fixed to a side of the vibration diaphragm on which the voice coil units are attached, and a part of the FPCB not attached and fixed to the vibration diaphragm extends to the side of the mounting plane away from the vibration diaphragm through the sound holes.

6. The tablet woofer according to claim 5, wherein, the FPCB has a strip shape; and a middle part of the FPCB is attached and fixed to the vibration diaphragm, and both ends parts of the FPCB extend to the side of the mounting plane away from the vibration diaphragm through the edge sound holes.

7. The tablet woofer according to claim 6, wherein, both ends of the FPCB are bent in an arc shape to a position in parallel with the mounting plane.

8. The tablet woofer according to claim 1, wherein, both front and back surfaces of the FPCB are provided with pads, and there is a one-to-one correspondence relationship between the pads provided on the front surface of the FPCB and the pads provided on the back surface of the FPCB; and, wherein, the pads provided on the front surface of the FPCB are electrically connected with each of the voice coil units, respectively, and series or parallel connections between the voice coil units are controlled by the pads provided on the back surface of the FPCB.

9. The tablet woofer according to claim 1, wherein, the FPCB is made of a Polyimide CCL (Copper Clad Laminate) base material.

* * * * *